United States Patent [19]

Kistner et al.

[11] 4,075,917

[45] Feb. 28, 1978

[54] DEVICE FOR CUTTING A PILE OF SHEETS WITH A DISK-KNIFE

[75] Inventors: Hermann Kistner, Tamm; Gunthart Lehmann, Heubach, Lautern, both of Germany

[73] Assignee: Maschinenbau Oppenweiler GmbH, Oppenweiler, Germany

[21] Appl. No.: 672,389

[22] Filed: Mar. 31, 1976

[30] Foreign Application Priority Data

Apr. 4, 1975 Germany ..... 2514836

[51] Int. Cl.[2] ..... B26D 7/06

[52] U.S. Cl. ..... 83/422; 83/435; 83/508; 83/925 A

[58] Field of Search ..... 198/165, 628; 83/422, 83/425, 434, 435.2, 508, 925 A; 156/477 B

[56] References Cited

U.S. PATENT DOCUMENTS

| | | | |
|---|---|---|---|
| Re. 10,875 | 10/1887 | Jarves | 83/435.2 |
| 931,223 | 8/1909 | Ross et al. | 83/435.2 X |
| 1,248,748 | 12/1917 | Stuedeman | 83/435.2 X |
| 1,291,811 | 1/1919 | Ellis | 83/435.2 X |
| 1,825,205 | 9/1931 | Reynoldson | 83/425 X |
| 2,664,927 | 1/1954 | Pierle | 83/435.2 X |
| 2,720,231 | 10/1955 | Hessler | 198/628 |
| 2,829,683 | 4/1958 | Skinner et al. | 83/435.2 X |
| 2,842,169 | 7/1958 | Joa | 83/435.2 X |
| 3,053,291 | 9/1962 | Meissner et al. | 83/435.2 X |
| 3,262,545 | 7/1966 | Worsencroft | 198/628 |

FOREIGN PATENT DOCUMENTS

| | | | |
|---|---|---|---|
| 567,520 | 12/1958 | Canada | 198/165 |
| 1,351,277 | 4/1976 | United Kingdom | 198/165 |

*Primary Examiner*—Travis S. McGehee
*Assistant Examiner*—John Sipos
*Attorney, Agent, or Firm*—Wigman & Cohen

[57] ABSTRACT

A device for cutting a pile of sheets with a disk-knife having an associated conveyor for continuously supplying the pile of sheets to the disk-knife, being of relatively simple construction and guaranteeing a satisfactory smooth cut acceptable for a visible surface.

18 Claims, 8 Drawing Figures

DEVICE FOR CUTTING A PILE OF SHEETS WITH A DISK-KNIFE

BACKGROUND OF THE INVENTION

1. Field of the invention

The invention pertains to a device for cutting a pile of sheets by means of a disk-knife or revolving blade with which is associated a conveyor feeding the pile of sheets to the disk-knife while holding them between opposite clamping surfaces of two conveyor elements, at least one of which is an endless belt.

2. Description of the prior art

In what follows, the term "pile of sheets" shall mean any pile (or set) of sheets or folios which lie on top of each other, for example a book, a sheet folded several times, a booklet, a signature, etc..

The term "booklet" shall mean a pile of sheets, consisting of sheets lying on top of each other and all of which are folded around a common fold which forms the "back" of the booklet. The folios or sheets forming the booklet can be stapled or glued at the back. However, they can also be joined loosely to each other. Such a booklet may be called also a "signature".

The term "cutting a pile of sheets" shall include the so-called "trimming", in which the edges of a pile of sheets, for example the edges of a booklet, are cut, because even when only its edges are trimmed, the pile of sheets has to be cut through.

The term "elongated, flexible, endless conveyor element" is to be understood as a generic term for endless belts, strips, chains, ropes, strings, cords or the like.

The prior art shows, for example, at the delivery end of folding machines, the use of disk-knives for trimming the edges of booklets or for cutting the booklets in the middle. However, in these known devices each disk-knife has a cylindrical counter knife associated with it. The disk-knife for cutting through the booklet has a circumferential cutting edge whose cross-section is an acute angle and whose side next to the counter knife is plane. The counter knife is formed by the circumferential corner, virtually right-angled in cross-section, of a cylinder. The latter and a second cylinder, whose axis is concentric with that of the disk-knife, form a clamping-slit for the booklet. With increasing thickness of the booklet, the point at which the disk-knife starts its cut moves farther and farther away from the clamping slit in a direction opposite to the direction in which the booklet advances, so that the disk-knife must penetrate into the booklet at a point at which the booklet is not supported by the counter knife nor gripped in the clamping slit. The consequence is that, at the point of penetration of the disk-knife, the individual sheets of the booklet are not secured against displacement relative to each other. Thus, as the disk-knife penetrates into the booklet, the position of the sheets is distorted and the cut becomes necessarily more and more irregular with increasing thickness of the booklet.

With folding machines, a somewhat irregular cut has but little significance, because the booklets are usually units or sections of books (signatures), which after the binding process has been completed, are again trimmed by means of a guillotine knife.

Devices of the type just described, have been disclosed in U.S. Pat. Nos. 1,704,454 and 1,835,685. These references take the knowledge described above as point of departure, namely, that a pile of sheets cannot be cut cleanly with a disk-knife, because the disk-knife displaces the sheets relative to each other, and that, for this reason, the trimmed back of the book does not extend at a right angle to the sides of the book. (U.S. Pat. No. 1,835,685 p.2, lines 68 to 73). Therefore, in the just mentioned reference, it is proposed to use two disk-knives, arranged on opposite sides of the pile of sheets in such a manner, that the plane sides of their cutting edges point in the same direction and lie in the common cutting-plane; furthermore, each disk-knife is arranged to cut into the pile of sheets somewhat beyond the half-way line. It is apparent, that with this known device one cannot produce a cut suitable, for a visible surface, because the aforementioned device does not furnish a scissor-cut and the two cutting edges, mounted some distance apart from each other, without a counter knife, merely penetrate into the pile of sheets. For this reason, the known devices are proposed only for the trimming of backs of books, which are glued subsequently. For this purpose, a rough cut is even desirable for a better penetration of the glue. In addition, it would be pointless to produce a surface which appears clean-cut to the eye, because the backs of the books are grooved in any event to make it easier to glue on the backbone of the book, as has been brought out in the above-mentioned references.

In this known device, the conveyor consists of two parallel sections of two endless chains, made of links and bolts. These chains are provided with support members, which furnish a plane support surface when the chain section moves in a straight line. The chain links are fastened together with bolts, the ends of which are provided with rollers which move on support surfaces. This results in a very complicated conveyor, which does not lend itself to the production of a scissor-cut with a disk-knife, because the support members cannot be used as counter knives for the disk-knife, in view of the fact that this counter knife formed by the support members would be continually interrupted as the individual supports move past the disk-knife, a fact which would result in an uneven cut. Furthermore, the journals of the rollers at the ends of the bolts would be highly stressed by bending and shearing forces.

It seems that, for the above-mentioned reasons, the devices disclosed in the two cited U.S. patents have not proven themselves as means for cutting the backs of books. For that purpose, according to West German OS-publication 2,416,461 milling cutters or saws are used with a peripheral speed several times greater than the forward speed of the pile of sheets. The use of milling cutters and saws has the advantage that it avoids the high cutting pressure when the paper is sheared off which results from the tearing of the paper fiber at the cutting point. This tearing of the paper fibers results in a rough cut which is desirable for the trimming of the back of a book to be glued subsequently. In any case, none of the cited processes makes it possible to obtain a cut with a circular cutter leaving a smooth appearing edge surface on a pile of sheets, for example, on a booklet or a book.

For this reason, guillotine knives have been used exclusively until now for trimming piles of sheets, such as books, booklets, etc., whenever a smooth looking cutting surface is to be obtained. Guillotine knives furnish a very smooth, clean cut, because, in this instance, a pressure bar adjacent to the knife holds the sheets and presses them together so that they cannot shift before and while the knife penetrates into the pile. However, the guillotine cutting devices have the disadvantage that, during the cutting process, the pile of sheets to be cut must remain stationary relative to the cutting device. But this requires that the pile of sheets is brought to and removed from the cutting device in step-like fashion, which diminishes the capacity (output) of such a cutting device. To avoid this loss of capacity, decades of development of the guillotine knife have led to an elaborate cutting device disclosed in U.S. Pat. No. 3,552,246 in which the step-wise transporting of books has been eliminated by a mechanism, in which the entire guillotine cutter assembly oscillates back and forth in the direction of travel of the pile of sheets. This shows that industry did not hesitate to utilize highly advanced technical solutions to eliminate the disadvantage of intermittent transport of the pile of sheets.

It is the purpose of the present invention to obviate the aforementioned difficulties by providing a device for cutting a pile of sheets with a disk-knife, wherein the pile of sheets can be supplied to the disk-knife in uninterrupted, continuous flow and which, with a relatively simple construction will guarantee a satisfactory, smooth cut, acceptable for a visible surface.

SUMMARY OF THE INVENTION

The preferred embodiment of the present invention solves the problem inherent in the apparatus of the types aforementioned in the field of invention in the following manner: The section of the endless belt, on the side which faces away from the clamping surface, is in contact with rolling bodies, at least in the cutting range of the disk-knife, while the rolling bodies on their side away from said belt section are supported on a support surface of a support structure. Thus, a clamping surface is created for the clamping slit or gap, in such a manner that the clamping surface can move in steady, continuous motion relative to the disk-knife, transporting the pile of sheets to and away from the disk-knife, while at the same time said clamping surface, is also capable of taking up the pressure perpendicular to the direction of motion, for example, the clamping pressure of a second conveyor element traveling with the pile of sheets and/or the cutting pressure of the disk-knife. Especially advantageous is the fact that the rolling bodies are stressed only in compression and that the pressure is easily transmitted through the support surface to the support structure. Therefore, the invention permits an especially simple and a very rugged construction.

A belt suitable for passing over rolling bodies, supported by a support surface, would be one which lies uniformly flat against the pile of sheets and which, for example in the form of a steel belt, can serve as a counter-knife for the disk-knife. The rolling bodies can be spheres, but are preferably cylinders, rollers or needles. The rolling bodies can be made to travel in an endless path around the support structure. But, preferably, they can be connected to each other to form an endless chain. For example, each cylinder or roller can be fastened to the immediately adjacent cylinders or rollers by means of movable links. These links and their connections are not subjected to the pressure exerted on the cylinders or rollers, but merely hold them together.

To trim the upper and lower edges at right angles to the back of a booklet, the latter can be arched around an axis parallel to the back. But when the edge which lies opposite the back of a booklet is to be trimmed, the booklet has to be flat, as it is fed to the cutting device. Now, a special advantage of the invention resides in the fact, that the support surface can be formed to suit the manner in which the pile of sheets is to be fed to the disk-knife; it can be made as a plane surface, when the sheets have to lie flat; or it can be made as a convex surface, when the sheets are to be arched around an axis perpendicular to the cutting plane.

For example, in an advantageous embodiment of the invention, both conveyor elements can be made as endless belts. If both clamping surfaces are to be plane, then both belt sections have to be supported by rolling bodies which in turn are supported by a plane surface of the support structure. On the other hand, if one support surface is convex, for example, the surface beneath the first belt which is farther away from the axis of rotation of the disk-knife, then, the second belt nearest the axis of rotation of the disk-knife can be deflected in a section governed by the location of two pulleys by the first belt, and the pressure between the two clamping surfaces can be made to depend only on the tension in the second belt which is nearest the axis of rotation of the disk-knife. This leads to an especially simple construction, in which the convex surface of the only support surface can be built so as to meet the demands.

An advantageous embodiment of the invention can be made so that a V-belt forms the endless belt and the rolling bodies are rollers, provided with a circumferential groove, which is appropriately fitted to the V-belt profile. In this way, the V-belt is not merely supported, but also firmly guided laterally, by the support rollers.

In another advantageous embodiment of the invention, the endless belt can serve as conveyor element on the side away from the axis of rotation of the disk-knife. Here, the arrangement can be such, that one of its longitudinal edges will serve as counter knife for the disk-knife. However, it is also possible to have on the endless belt a cuttable layer, into which the edge of the disk-knife penetrates. In both of the last mentioned cases, it is advantageous to use a steel strip as the endless belt. Still further embodiments and advantages of the present invention will readily occur to one skilled in the art to which the invention pertains, upon reference to the following detailed description.

BRIEF DESCRIPTION OF THE DRAWINGS

The description refers to the accompanying drawings in which like reference characters refer to like parts throughout the several views and in which.

DESCRIPTION OF THE PREFERRED EMBODIMENTS

Figure 1:
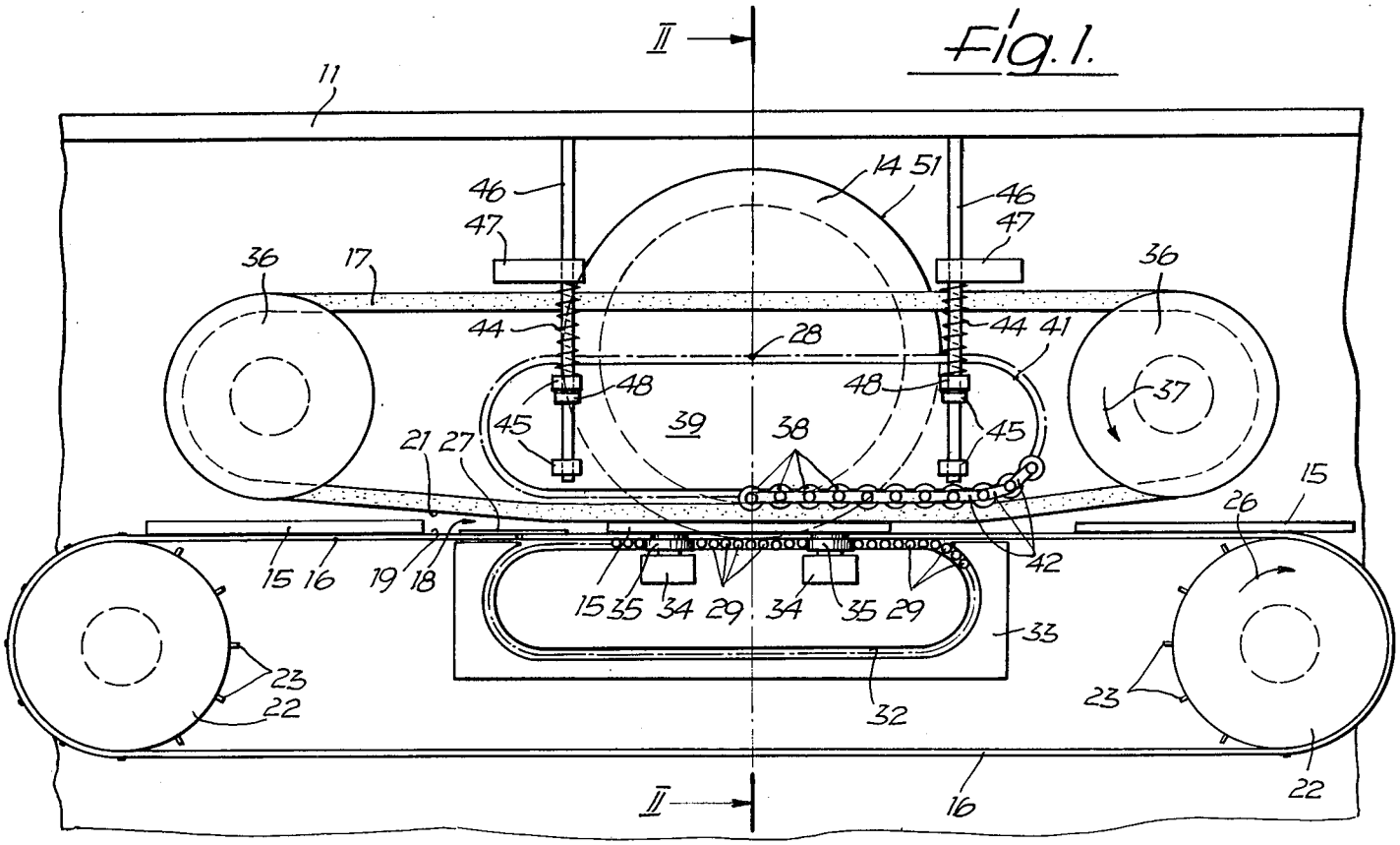
FIG. 1 is a simplified, schematic side view of a first embodiment.
Figure 2:
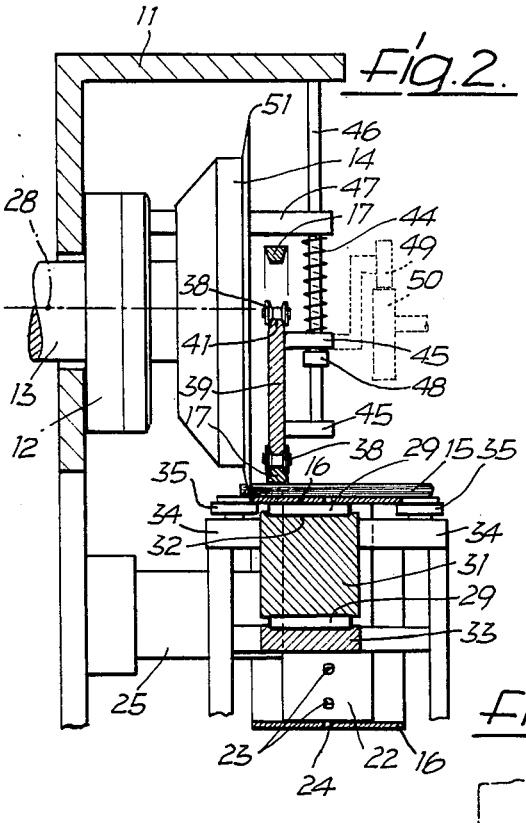
FIG. 2 is a sectional view on line II — II in FIG. 1.
Figure 3:
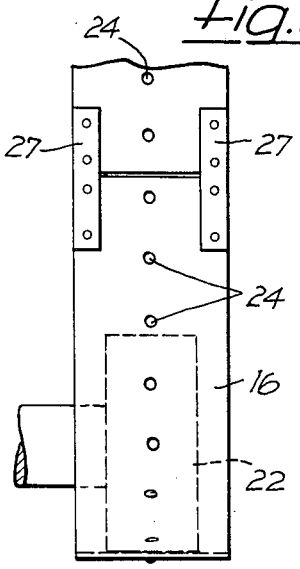
FIG. 3 is a partial top-view of a joint of the steel-belt.

Referring to the drawings, the invention is described with reference to a device for cutting a pile of sheets, as illustrated in FIGS. 1–3. FIGS. 1 and 2 show a part of the frame 11, to which is fastened a bearing 12 for the drive shaft 13 of disk-knife 14. The shaft 13 is driven, in a known manner, by a motor, which is not shown on the drawing.

To feed booklets 15 to the disk-knife 14, there is provided a conveyor which consists of two elongated, flexible, endless conveyor elements, namely, an endless steel belt 16 and an endless V-belt 17, these are mounted one above the other in such a manner that the neighboring sections of the two belts form a clamping gap or slit 18 in which the incoming booklets 15 are clamped together by the oppositely situated conveyor surfaces 19 and 21 of the steel belt 16 and the V-belt 17 respectively, and then the booklets are fed to the disk-knife 14. The disk-knife 14 is mounted on its drive shaft 13 so that it connot be rotated on the shaft, but it can be moved axially and it can also be fixed solidly (after it has been set for a desired position on its shaft 13). The steel belt 16 is mounted on two pulleys 22, which have radial protrusions 23, which fit into holes or recesses 24 (FIG. 3) of the steel belt 16. The two pulleys 22 are mounted in bearings 25, which are rigidly fastened to the frame 11. The pulley 22 on the right-hand side of FIG. 1 can be driven in the direction of the arrow 26 by a driving mechanism not shown in the drawing. To form an endless steel belt, the two ends of a steel strip are fastened together by straps 27 (FIG. 3).

Within the cutting range of the disk-knife 14, the upper section of the steel belt 16, on the surface of which faces away from the axis of rotation 28 of the disk-knife 14, is supported by rolling bodies, namely rollers 29, arranged parallel and next to each other on an endless support surface 32 formed by the circumferential surface of a support structure or body 31. The support body 31 is cut from a steel plate and, together with a casing 33, which encloses the lateral and bottom sections of the support surface 32 for guiding the rollers on these sections, it is fastened to the frame 11 by means of struts 34; the construction is such, that the casing 33 gives the rollers 29 the freedom necessary to correctly support the upper section of the steel belt 16. An axial displacement of the rollers 29 is avoided by making the support surface 32 in the form of the bottom of a continuous groove in the support body 31, the width of the groove corresponding exactly to the length of the rollers 29. This permits a very simple solution: The rollers can be very simple cylindrical members, which are placed loosely next to each other on the bottom, namely, the support surface 32, of the groove. In order to guide the steel belt 16 in an exactly defined lateral position, two pairs of guide rollers 35, each roller rotatable around a vertical axis, are mounted on upper braces or struts 34 one roller of each pair being arranged on each side of the steel belt so that the lateral edges of the steel belt 16 touch the rollers. One pair each of these guide rollers 35 is mounted immediately before and immediately beyond the cutting range of the disk-knife 14, so that, in this way, the steel belt is very accurately guided within the cutting range.

The V-belt 17 passes over two pulleys 36, which are supported by bearings, fastened to the frame 11 in a manner similar to that shown for pulleys 22; but for simplicity, the bearings for the pulleys 36 are not shown in the drawing. The pulley 36 on the right hand side in FIG. 1 can be driven, in the direction of arrow 37, through a clutch with a speed which gives the V-belt 17 a linear velocity of advance only slightly less, for example only 1% less, than the linear (speed) velocity of advance of the steel belt 16.

Figure 5:
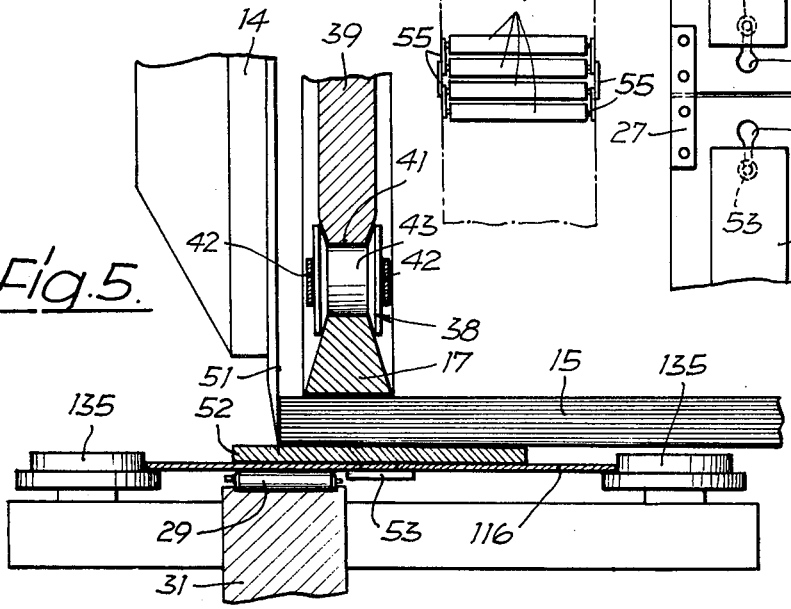
FIG. 5 is an enlarged partial section of a variation of the embodiment, the section corresponding to that of FIG. 2.

Within the cutting range of the disk-knife 14, the lower section of the V-belt 17, on the surface thereof facing the axis of rotation 28 of the disk-knife 14, is supported by rollers 38, which are arranged parallel and next to each other and are in rolling contact with a support surface 41 of a support body 39. The rollers 38 are connected by links 42, so that all the rollers 38 together form an endless roller chain. Each one of the rollers 38 has a circumferential groove 43, commensurate with the V-belt profile, so that the inner rim of the endless V-belt 17 will fit into it. (FIGS. 2 and 5.)

The support body 39 for the V-belt 17 is cut out of a steel plate, just as the support body 31. Its rim is formed to correspond to the profile of the grooves 43, so that the rollers 38 are securely guided by the support body 39. The latter, just as the support body 31, constitutes a horizontally extended body with rounded ends and is mounted so that it can move vertically against the force of springs 44. For this purpose, there are fastened to each of the two ends of the support body 39 two horizontally extending arms 45, one above the other, which at their free ends have holes for two vertical guide rods 46, which are fastened to the frame 11. The springs 44 are shown as spiral compression springs, which surround the guide rods 46 and whose lower ends rest on the corresponding upper arms 45 and whose upper ends are in contact with arms 47 mounted on frame 11, so that through these springs 44 the support body 39 is pressed downward, until the upper arms 45 of the support body 39 are in contact with stops 48, which are rigidly fastened to the guide rods 46. The stops 48 are movable along the guide rods 46 and can then be fastened on them, so that, by means of the stops, the clamping slot 18 can be adjusted to the desired height. To allow for adjustments of the support body 39 and yet retain satisfactory guidance of the V-belt 17, the latter is made of an elastically deformable material. However, it can also be made from a non-stretchable material, or it can be reinforced with steel wires to make it non-stretchable. In such a case, it is necessary to provide for the upper section of the V-belt 17 a spring loaded idler pulley, which permits a downward elastic displacement of the lower V-belt section, supported by the rollers 38. The springs 44 must then be chosen so that the (downward) force exerted by them is greater than the upward force on the support body 39, which is caused by the tension of the V-belt, and the force exerted by the springs 44 must be sufficiently great so that, after overcoming the force resulting from the tension in the V-belt 17, the net force will product the clamping pressure necessary to hold booklet 15 together, while it is cut with the disk-knife 14.

In FIG. 2, the dashed lines show a variation of the above embodiment, where the two upper arms 45 are each associated with a follower roller 49, rotatable on a horizontal axis; each follower roller contacts a disk cam 50 below it, and the bearings for the cam shafts are fastened to the frame 11. The cam 50 is driven by the drive mechanism of the device in such a manner, that the upper support body 39 is lifted shortly after a booklet 15 has been cut, and that shortly after a new booklet has been fed into the clamping slot 18, the upper support body 39 is again lowered into the clamping position, in which the V-belt 17 then exerts the necessary pressure on the booklet for the next cutting operation.

On the side facing the steel belt 16, the disk-knife 14 forms a plane, which contains the cutting edge 51. Through the guide rollers 35, the steel belt 16 is held in such a position, that its edge next to the disk-knife 14 (which is in FIG. 2 the left side) touches the plane side of the disk-knife 14, thus providing a scissor-like counter blade for the disk-knife.

During operation, a conveyor, not shown in the drawing, pushes onto steel belt 16, which moves continually in the direction of arrow 26, the booklets 15 to be trimmed on the side opposite the back. The alignment of the booklet 15 is accomplished in a known manner by a guide strip, not shown in the drawing, against which the booklet is pushed by means of rollers, also not shown, mounted above the steel belt so that their axes of rotation form an acute angle with the axes of rotation of the pulleys 22, so that the booklet is always pushed with a light pressure against the guide strip for the backs of the booklets. Conveyors of this type are known, so that a representation and more detailed description can be omitted for simplicity. The drive for the pulleys 22 is thereby synchronized with the supply of the booklets 15 such that the latter are always pushed onto the steel belt 16 in such a manner that the straps 27 are always located between the booklets 15. In FIG. 1, the disk-knife 14 is driven counter-clockwise so that the circumferential velocity of its cutting edge is a little higher than the forward travel velocity of the booklets 15, so that the edge 51 engages the booklet fed to it with a lightly pulling cut.

During the trimming, the booklet is firmly clamped together by the pressure of springs 44, immediately adjacent to the line of the cut, in the clamping slot. Since, in this case, the edge parallel to the cut should not be arched, those sections of the support surfaces 32 and 41 which face each other are linear and parallel to each other. The compressive forces acting on the steel belt 16 and the V-belt 17, in consequence of the clamping pressure, are transmitted to the support bodies 31 and 39 by the rollers 29 and 38 respectively, whereby the rollers 29 and 38 are stressed only in compression.

Figure 4:
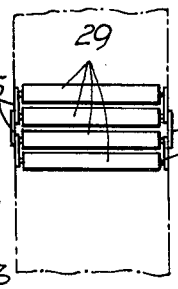
FIG. 4 is a top-view of rolling bodies in the form of cylinders which are connected to each other by means of links.

FIG. 4 illustrates a minor variation, which consists of the following: each roller 29 as well as each roller 38 is connected to its immediate neighbors by the links 55 to form a kind of roller chain. With this connection of the rollers 29, the casing 33 is not required.

Figure 6:
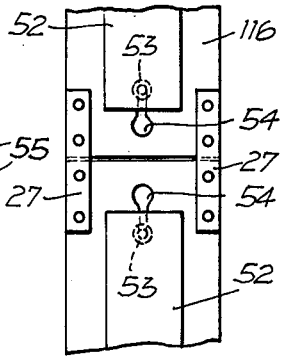
FIG. 6 is a partial view, similar to FIG. 3, of the steel belt for the embodiment indicated by FIG. 5, but drawn to a smaller scale than FIG. 5.

In FIGS. 5 and 6 is shown another variation of the embodiment illustrated in FIGS. 1 to 3. This embodiment differs from the embodiment shown in FIGS. 1 to 3 in this way: Here, the steel belt 116 is not supported as a counter knife next to the disk knife 14, but it is passed beneath the disk knife 14 by the guide rollers 135 and there it is supported by the rollers 29. In this embodiment, the counter knife is formed by a strip 52, consisting of a cuttable material, for example, a synthetic material, which is stretched over the steel belt 116, and into which the cutting edge 51 of the disk-knife 14 penetrates. To connect the synthetic strip 52 with the steel belt 16, both ends of the synthetic strip 52 are provided with mushroom-like protrusions 53, the stems of which fit into slits 54 at the ends of steel belt 116. The slits 54 are enlarged in bayonet fashion towards the ends of the steel belt 116 for passing through the heads of the mushroom-like protrusions. By choosing for the synthetic strip 52 a length appropriate for the distance between these slits 54, the synthetic strip can thus be fastened to the steel belt 116, before the latter is placed on the pulleys 22. For the heads of the mushroom-like protrusions 53, the pulleys 22 can be provided with circumferential grooves, so that these protrusions will not interfere with a smooth run of the steel belt over the pulleys.

The embodiment in accordance with FIGS. 5 and 6, compared to the embodiment of FIGS. 1 to 3, has the advantage that, here, during the trimming of the booklet 15, the booklet is supported on both sides of the cutting plane by the synthetic strip 52, as illustrated in FIG. 5. When after prolonged use the synthetic strip 52 is worn down by the cutting edge of the disk-knife 14, at the place where the cuts are made, the disk-knife 14 can first be moved axially by small amounts and then be locked in different axial positions on its drive shaft, and can be used again several times. When these possibilities have been exhausted the synthetic strip can be removed, and it can then be re-mounted on the steel belt 116 with the interchanged ends, so that the other, not yet worn side will serve as support directly under the cutting edge 51 of the disk-knife 14.

Figure 7:
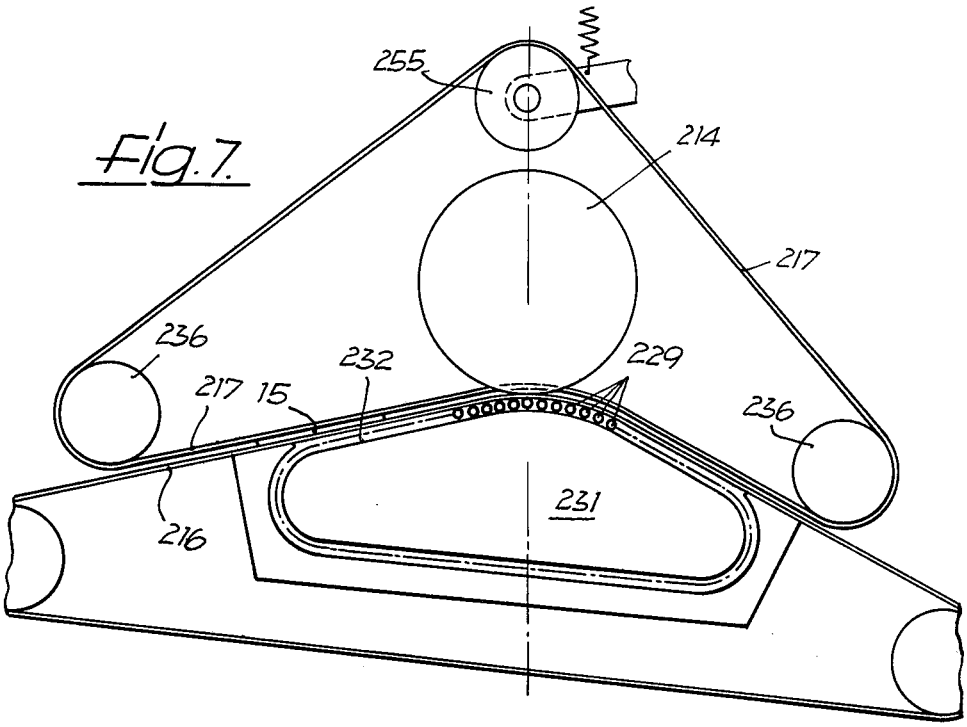
FIGS. 7 and 8 are illustrations of a third embodiment corresponding to the views shown in FIGS. 1 and 2.
Figure 8:
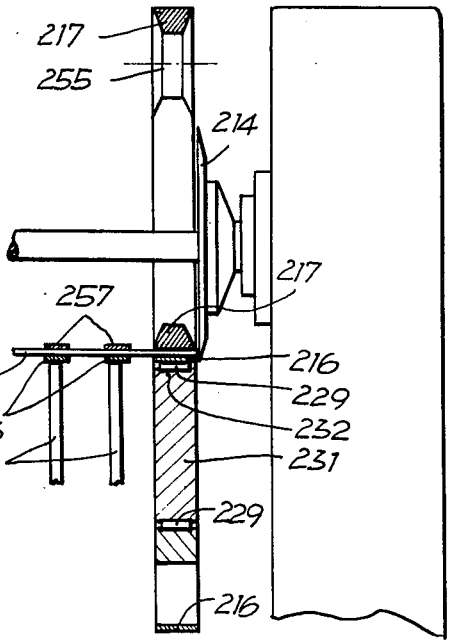

In FIGS. 7 and 8 of another embodiment, parts which correspond to the embodiment of FIGS. 1 to 3 have been given reference numbers 200 units higher than those used for the first embodiment, so that thereby reference is made to the description of the embodiment shown in FIGS. 1 to 3.

The embodiment shown in FIGS. 7 and 8 differs from that shown in FIGS. 1 to 3 in this respect: Within the cutting range of the disk-knife 214, the support body 231 for the steel belt does not form a plane, but a convex, arched support surface 232 for the rollers 229. This curvature is here utilized to deflect the V-belt 217, which passes over pulleys 236 and a spring-loaded idler 255, so that the V-belt is pressed against a booklet 15, placed between the steel belt and the V-belt, where the clamping pressure results from the V-belt deflection against the forces caused by the spring loaded idler. This has the advantage that now for the production of the clamping pressure through the V-belt 217, a second support body, corresponding to support body 39, is unecessary. With this form for the embodiment of the invention, it is always possible to trim booklet edges which may be arched during the cutting process, as for example the upper and lower edges of a booklet or signature. For this reason, it can be advantageous to construct the device of FIGS. 7 and 8 so, that it consists of two parts, one being built as the mirror image of the other, which then can trim simaltaneously both aforementioned booklet edges. In the space between the two edges, booklet 15 can be guided by belts 256 and 257 which run parallel to the steel belts 216 and the V-belts 217 respectively and which pass over pulleys 258.

In the examples described above, the lower belt is shown as a steel belt 16, 116, or 216, and the upper belt as a V-belt 17, or 217. This selection of belts has proven to be especially advantageous. However, the invention can also be used to advantage with another solution. For example, for the lower belt one may use a V-belt or a conveyor belt of conventional kind, for example, a reinforced or not reinforced belt of synthetic fiber, or the like. Also, for the upper belt, a steel belt might be used instead of the V-belt. Instead of belts, also ropes, strings or chains may be utilized. The use of chains offers itself especially for the belt which does not act as counter-knife. In this case, the chain can be provided with support members, which are shaped to form a coherent surface where they are in contact with the booklet.

As shown in the illustrated examples, the cutting edge of the disk-knife overlaps very little with the counter-knife formed by the steel belt 16, or the synthetic strip 52, which is essential for attaining a wedge opening between the two blades with a wedge angle as acute as possible.

The belt supported in accordance with this invention can also be supplied on one side only, when the other side of the pile of sheets to be cut is supported by other means, for example, when for the side facing the disk-knife axis of rotation 28 a different support or pressure device, such as pressure cylinders etc. is provided.

Although the invention has been illustrated and described with reference to the preferred embodiments thereof, it should be understood that it is in no way limited to the details of such embodiments, but is capable of numerous modifications within the scope of the appended claims.

What is claimed is:

1. In a device for conveying and cutting a pile of sheets, the combination of:

a frame;

at least one disk knife supported on said frame for rotation about its axis, said disk knife having two sides, one of said sides having a circumferential planar portion, said planar portion being surrounded by a circular cutting edge, at least said planar portion of said one side and said cutting edge defining a common plane extending at right angles to said axis of rotation;

a conveyor for feeding the pile of sheets to said disk knife in a conveying direction, said conveyor including first and second elongated, flexible, endless conveyor elements having clamping parts, deflecting means for supporting said conveyor elements on said frame for revolving movement along endless paths so that the clamping parts of said conveyor elements extend along each other and the circumferential surfaces of said clamping parts confront each other and define a clamping gap for the pile of sheets, said first conveyor element being located farther away from said axis of said disk knife than said second conveyor element and being formed as a first endless belt having a portion forming a counter knife and a first and a second surface said first surface confronting said clamping gap, said disk knife and said first endless belt being mutually so arranged that a part of said planar portion and cutting edge overlaps and contacts said counter knife of said first endless belt, so that said disk knife and said counter knife of said first endless belt constitute a cutting device for cutting the pile of sheets with a scissor-like cut in a cutting range of said conveyor;

a first set of rolling bodies supporting said second surface of said first belt at least in said cutting range; and a first support structure supported on said frame and having a support surface for supporting said first set of rolling bodies.

2. A device as defined in claim 1, wherein a second set of rolling bodies is provided for supporting said clamping part of said second endless conveyor element on the surface thereof directed away from said clamping gap at least in said cutting range and wherein a second support structure is supported on said frame for supporting said second set of rolling bodies.

3. A device as defined in claim 2, wherein said second conveyor element is formed as a second endless belt.

4. A device as defined in claim 1, wherein said first set of rolling bodies are designed as rollers.

5. A device as defined in claim 1, wherein guide means are provided for guiding said rolling bodies to move in an endless path around said support structure.

6. A device as defined in claim 4, wherein said rollers are connected with each other so as to form an endless chain.

7. A device as defined in claim 6, wherein links are provided at both ends of each roller for movably connecting directly adjacent rollers to each other, in chain-like fashion.

8. A device as defined in claim 1, wherein lateral guide means are provided for the lateral guidance of said first endless belt, said first endless belt having longitudinal edges, said lateral guide means contacting the longitudinal edges of said first endless belt.

9. A device as defined in claim 3, wherein said second endless belt is a V-belt and said second set of rolling bodies are rollers which are provided with a circumferential groove, the cross-section of which corresponds substantially to that of the V-belt.

10. A device as defined in claim 1, wherein said first endless belt is a steel belt.

11. A device as defined in claim 10, wherein deflecting means for supporting said first endless belt are pulleys having radially protruding sprockets and wherein said steel belt has recesses for said sprockets.

12. A device as defined in claim 1, wherein said first endless belt has a longitudinal marginal edge comprising said counter knife.

13. A device as defined in claim 1, wherein said first endless belt includes a layer of cuttable material into which the cutting edge of the disk knife penetrates to overlap with and form said counter knife of said first endless belt.

14. A device as defined in claim 13, wherein the cuttable layer is formed by a strip of cuttable synthetic material, which has, on the surface thereof adjacent said first endless belt, mushroom-like protrusions at its ends, said mushroom-like protrusions each having a stem and an enlarged head, and wherein said first endless belt is provided with two slits for said stems of said protrusions, said slits having ends and extending substantially in the direction of the longitudinal axis of said first endless belt, the adjacent ends of said slits being enlarged for passing said heads therethrough.

15. A device as defined in claim 2, wherein said second support structure is movably supported on said frame for movement away from and towards said first conveyor element and including at least one spring means for pressing said second support structure in a direction towards said first conveyor element against a stop means.

16. A device as defined in claim 15, wherein said stop means is a cam.

17. A device as defined in claim 1, wherein said support surface of said first support structure has a convex curvature in a region of the clamping part of said first conveyor element and wherein said second endless conveyor element is supported by said deflecting means such that said clamping part of said second conveyor element is concavely deflected by said clamping part of said first endless conveyor element.

18. A device as defined in claim 2, wherein said second set of rolling bodies are designed as rollers and are connected with each other by links forming an endless chain.

* * * * *